US005975918A

United States Patent [19]

Quillet et al.

[11] Patent Number: 5,975,918

[45] Date of Patent: Nov. 2, 1999

[54] PROCESS FOR OBTAINING AN INPUT/OUTPUT CONNECTOR FOR PORTABLE COMMUNICATION DEVICE AND CONNECTOR OBTAINED BY THE SAID PROCESS

[75] Inventors: Thierry Quillet, La Milesse; Roger Sureau, Ardenay Sur Merize; Christian Tabareau, Le Mans; Olivier Gaumont, Yvre-L'Eveque; Hubert Le Goff, Pruille Le Chetif; Alain Gillet, Yvre-L'Eveque, all of France

[73] Assignee: Framatome Connectors International, Courbevoie, France

[21] Appl. No.: 09/058,621

[22] Filed: Apr. 9, 1998

[30] Foreign Application Priority Data

Apr. 11, 1997 [FR] France ..... 97 04583

[51] Int. Cl.[6] ..... H01R 9/09

[52] U.S. Cl. ..... 439/79; 439/936

[58] Field of Search ..... 439/79, 936

[56] References Cited

U.S. PATENT DOCUMENTS

| | | | |
|---|---|---|---|
| 4,820,196 | 4/1989 | Roselle et al. | 439/519 |
| 4,935,454 | 6/1990 | Koblitz et al. | 522/24 |
| 5,133,670 | 7/1992 | Doi et al. | 439/79 |
| 5,342,208 | 8/1994 | Kobayashi | 439/79 |
| 5,409,384 | 4/1995 | Green et al. | 439/67 |
| 5,490,786 | 2/1996 | Mosquera et al. | 439/79 |

FOREIGN PATENT DOCUMENTS

WO 96/07221 3/1996 WIPO .

*Primary Examiner*—Neil Abrams
*Assistant Examiner*—J. F. Duverne
*Attorney, Agent, or Firm*—Perman & Green, LLP

[57] ABSTRACT

An input/output connector for a portable communication device, wherein the input/output connector is intended to be surface mounted on a printed circuit board. The input/output connector comprises an insulating housing, contacts, and elastic means for holding the contacts. The insulating housing has two positioning dogs fixed to lateral parts of the insulating housing, wherein the two positioning dogs are to be soldered to the printed circuit board when the input/output connector is mounted thereto. The contacts are also to be soldered to the printed circuit board when the input/output connector is surface mounted to the printed circuit board. When the input/output connector is placed on the printed circuit board for surface mounting thereto, the elastic means hold the contacts pressed on the printed circuit board so that, the surface soldering of each contact to the printed circuit board is contained in a common reference plane for the coflatness of the said contacts. The housing has a rear part (7) with a reservoir for receiving an insulating compound (8).

9 Claims, 3 Drawing Sheets

PROCESS FOR OBTAINING AN INPUT/OUTPUT CONNECTOR FOR PORTABLE COMMUNICATION DEVICE AND CONNECTOR OBTAINED BY THE SAID PROCESS

Process for obtaining an input/output connector for portable communication device and connector obtained by the said process.

The present invention relates to a process for obtaining an input/output connector intended to be surface-mounted on a printed circuit board PCB comprising, among other things, an insulating housing on whose lateral parts are fixed two positioning dogs to be soldered to the PCB, contacts to be soldered to the PCB. It also relates to the connector obtained by the said process.

In a general and known manner, the input/output connector of a portable communication device, for example a mobile telephone, which is of very small dimensions, is surface-mounted on a printed circuit board PCB. For the sake of conciseness and simplification the printed circuit board will hereafter be referred to as PCB ("Printed Circuit Board"), the term commonly used by those skilled in the art. This connector thus makes it possible to connect and disconnect an exterior electronic device, equipped with a complementary connector, to the portable communication device so as to permit dialogue between the two devices, or the testing of the functions or components installed on the PCB. Given the very small size of the connector used for this type of application and the vital need for highly accurate positioning during the mounting thereof so that the bearing plane of the connector coincides or at least almost coincides with the plane of the PCB, specific means for positioning and fixing the connector as well as the contacts must be provided. Thus, when implementing the product, the surface-mounting of the component, and also throughout the lifetime of the portable device, sometimes under severe handling conditions, all the contacts of the complementary connectors should be able to engage with one another and ensure that the contact pressure is adequate for good electrical transmission. Thus, it has been observed that for this function to be effective, it is necessary for the bearing plane of the connector to coincide or at least almost coincide with the plane of the PCB. In fact, this coplanarity provides for an efficient answer to a requirement for so-called coflatness, necessary for the implementation of the surface-mounting process, which requirement implies that any contact must be located within a maximum tolerance interval, which is desired to be small (for example of the order of 0.1 mm), in relation to the plane of bearing of the connector on the PCB, which bearing plane defines the plane of reference for the said coflatness.

International application WO 96/07221 describes such a connector which uses metal soldering fixings intended for holding it and setting it in position on the PCB. However, the use of such fixings has a considerable drawback since it does not allow the abovementioned necessary accuracy and hence the coflatness requirement to be met sufficiently rigorously. This is because the fixings described rest on the PCB over the whole of the surface of their base whilst, moreover, the connector rests at the rear on the said PCB either on a mounting surface or on a set of contacts. Thus, three surfaces which are independent and consequently whose probability of being coplanar is extremely small, the two surfaces of the bases of the fixings and the surface via which the rear of the connector rests on the PCB, are in this case involved in determining the plane of bearing of the connector on the PCB. Moreover, the dimensional constraints of the product do not allow sufficiently accurate guiding of the contacts. All of the above implies that this bearing plane evidently cannot be determined in an accurate and reproducible manner and yet, as was stated earlier, this bearing plane defines the plane of reference for the coflatness of the contacts and thus a considerable scatter is created as regards the coflatness.

In this context, the object of the present invention is efficiently to overcome this considerable drawback exhibited by the prior art and proposes a process for obtaining an input/output connector which comprises an easily implemented operation which makes it possible to guarantee that the contacts, during mounting on the PCB, will all lie accurately and reproducibly at least in a predetermined tolerance interval, the maximum tolerance interval, and that the coflatness requirement can thus be satisfied rigorously.

To do this, the process for obtaining an input/output connector mentioned in the preamble is noteworthy in that it comprises an operation of cementing, in the course of which the said contacts are pressed and simultaneously cemented by means of an insulating compound in such a way as to be held constrained in a position such that each of the contacts is contained in a plane of reference for the coflatness of the said contacts.

In a subsidiary manner, the process for obtaining an input/output connector comprises an operation of cementing, in the course of which the said contacts are pressed and simultaneously cemented by means of an insulating compound in such a way as to be held constrained in a position such that each of the contacts lies in a predetermined tolerance interval with respect to a plane of reference for the coflatness of the said contacts.

In a first preferred embodiment, to allow a visual check during production on the presence of the deposition and on the homogeneity of the insulating compound, a colouring agent is added to the said insulating compound.

In another preferred embodiment, which may anyway be complementary to the first, to allow efficient checking during production by means of black light illumination, a fluorescent colouring agent is added to the said insulating compound.

In a likewise noteworthy manner, there is provision for the input/output connector obtained by the process according to the present invention to comprise, on its rear part adjoining the contacts, a means for receiving the insulating compound enabling the volume deposited to be checked.

Thus, the invention consists advantageously in constraining the contacts in a position such that each of the said contacts, once immobilized, that is to say cemented with the, for example, resin-based insulating compound, is contained in a plane of reference for the coflatness of the contacts or, at the worst, subsidiarily, lies in the predetermined maximum tolerance interval with respect to the said plane of reference. The technique utilized, simultaneous pressing and cementing, is accurate, efficient and reproducible and thus guarantees that the coflatness requirement is complied with in full. The cementing operation using an insulating compound, commonly referred to as the "compounding" operation by those skilled in the art, is of major importance as regards the control of the process, as it is imperative to be able to check, during production, for the presence of the deposition of the insulating compound and hence of the cement as well as the homogeneity of this deposition. To do this, the adding of a colouring agent to the cement permits simple visual checking while, moreover, the addition of a fluorescent colouring agent allows simplified checking by means of black light illumination, the image observed during such illumination making it possible to pinpoint the regions where the cement is poorly deposited. Furthermore, by virtue of the means for receiving the insulating compound which are provided on the rear part of the connector, it is made possible to control the volume of cement deposited, this receiving means making it possible to quantify the volume of cement and thus to permit perfect reproducibility of the "compounding" operation.

The following description, in conjunction with the appended drawings, the whole given by way of non-limiting example, will elucidate the manner in which the invention may be practised.

Figure 4A:
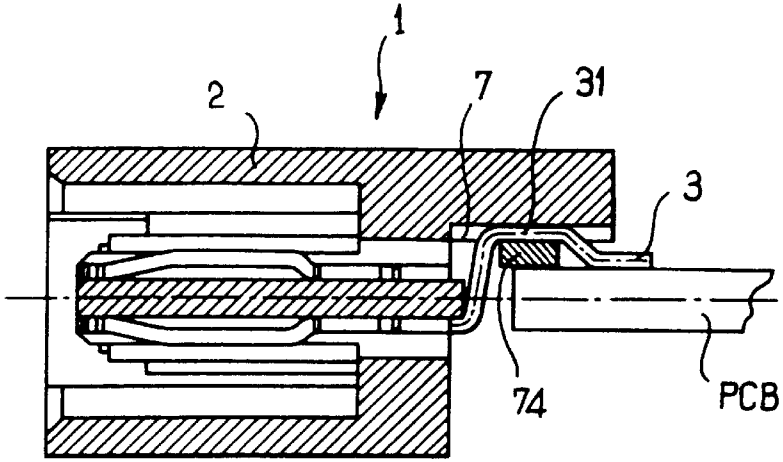
Figure 4B:
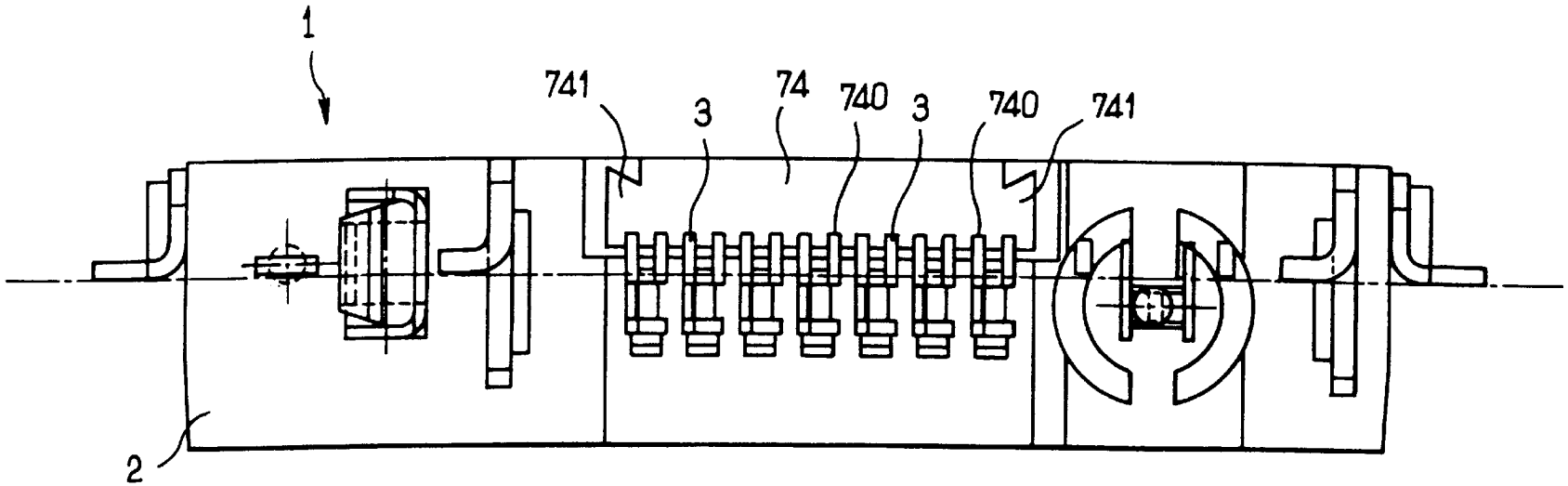

FIG. 4*a* shows a side view in section of a fourth embodiment of the connector according to the invention after it is mounted on the PCB while FIG. 4*b* is a rear view of the said connector.

Figure 1:
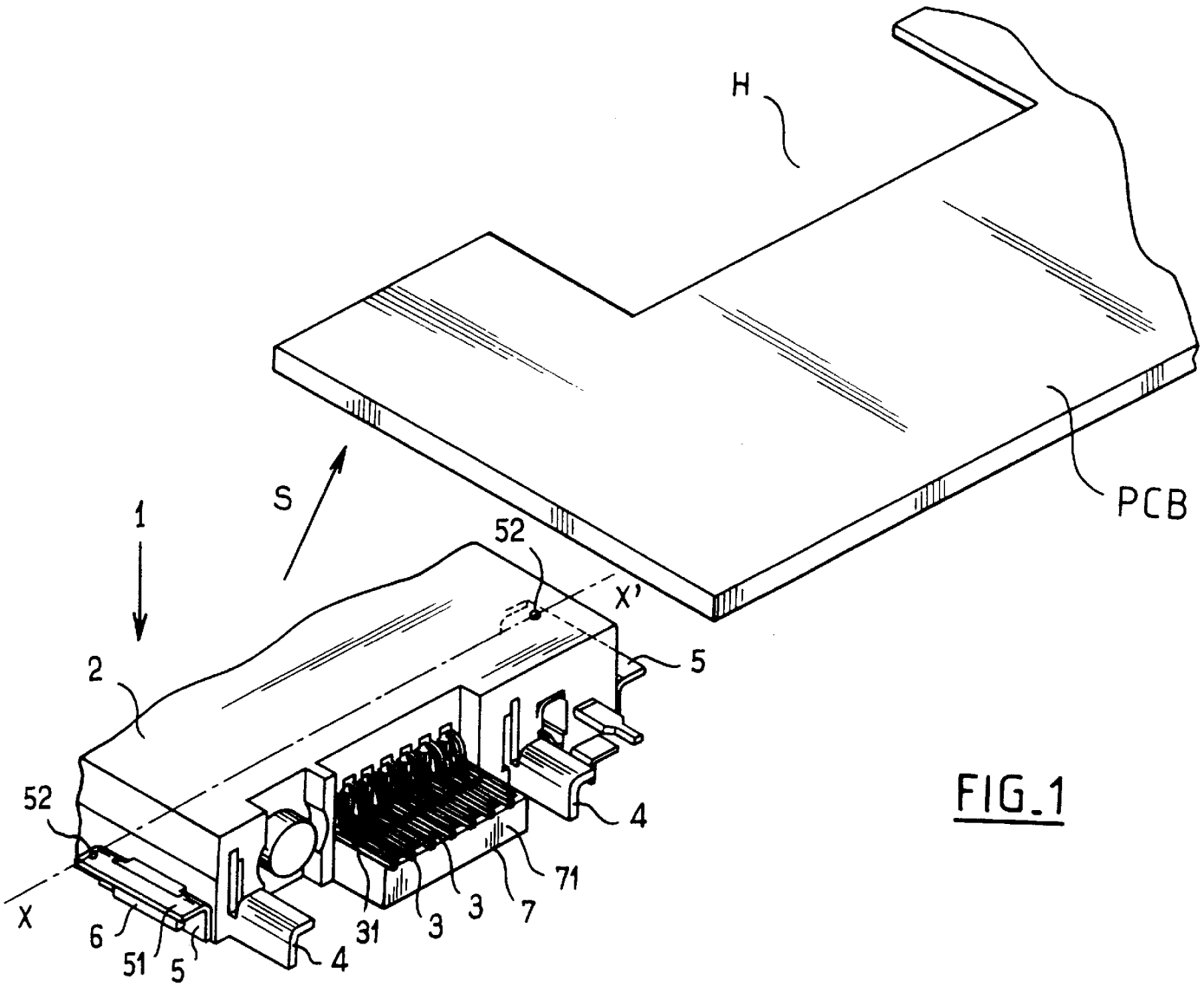
FIG. 1 represents the connector according to the invention in perspective and in a first embodiment before it is mounted on the PCB.

Represented in perspective in FIG. 1 is a connector 1 intended to be surface-mounted, that is to say to be soldered according to the "surface-mounted components" (termed SMC by those skilled in the art) technology, on a printed circuit board PCB which comprises a housing H to which the connector 1 is presented (the arrow labelled S in FIG. 1 specifies the direction of placement) and then jammed fast. The connector 1 consists chiefly of an insulating body 2, it comprises a set of contacts 3, a pair of interlocks 4 intended to be soldered to the PCB as well as a pair of positioning dogs 5 likewise intended to be soldered to the PCB to hold the connector in position on the said PCB. Preferably, the positioning dogs 5 are mounted in a removable manner on the body 2 which, in order to receive them, has on its two side walls two lugs 6 in the shape of an inverted L and under which each positioning dog 5 is slid and immobilized. Each positioning dog 5 can comprise, on its flat part 51 intended to come into contact with the PCB and located towards its end situated furthest outboard of the PCB, a projection or boss 52 of small height designed to form a point contact with that part of the PCB intended to receive it. The two points of contact of the two projections 52 therefore mathematically determine a straight line support for an axis of rotation XX' of the connector allowing it, while it is being mounted, to swing in such a way that the contacts 3 are brought close in turn to corresponding contact pads of the PCB (which are not shown in the drawing). This projection 52 and its characteristics are disclosed in detail in a U.S. patent application Ser. No. 09/058,382 filed on the same date by the same applicant, this Patent Application being incorporated herein by way of reference. In accordance with the invention the input/output connector obtained by the present process is noteworthy in that, on its rear part adjoining the signal contacts, it comprises a means 7 for receiving the insulating compound 8, making it possible to check the volume deposited. In the first embodiment according to FIG. 1 the means 7 for receiving the insulating compound is a reservoir in which the bowed part 31 of the contacts 3 is immobilized once the said contacts have been constrained, by and in the said insulating compound which is flush with the edges of the said reservoir, the contacts re-emerging towards the rear edge 71 of the reservoir in their region of soldering to the PCB.

Figure 2:
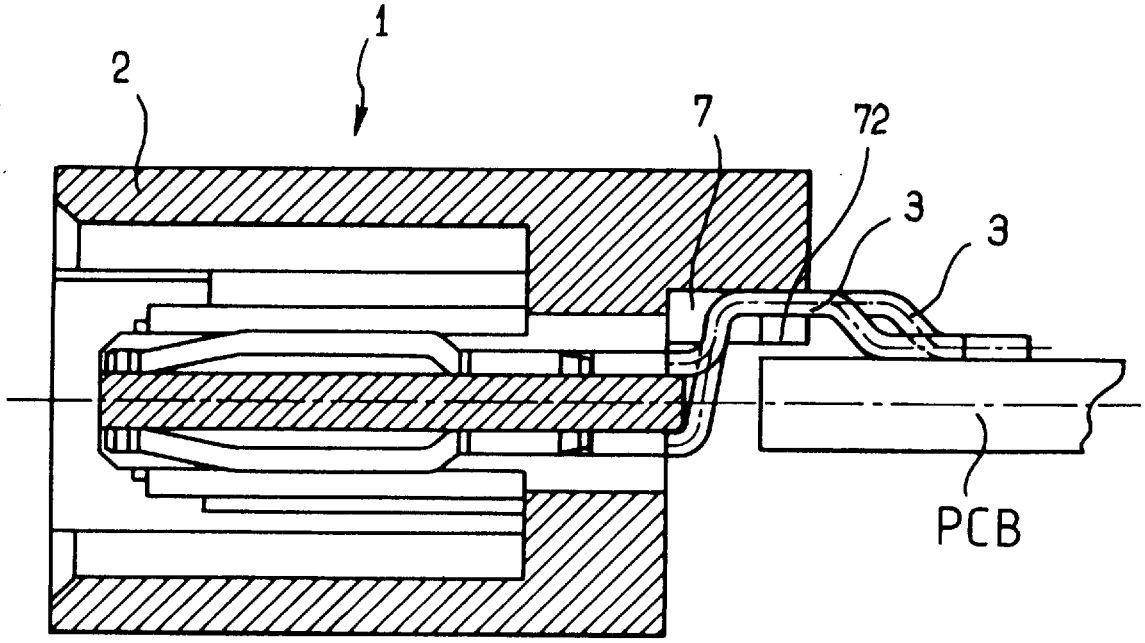
FIG. 2 shows a side view in section of a second embodiment of the connector according to the invention after it is mounted on the PCB.

In FIG. 2, the connector 1 is depicted in a side view, after it is mounted on the PCB, the same labels applying to elements identical to those of FIG. 1. In this second embodiment the means 7 for receiving the insulating compound forms a reservoir delimited in its rear part by notches for redirecting the contacts 3. In this way, not only are the contacts 3, in one portion of their bowed parts 31, immobilized by and in the insulating compound contained in the reservoir thus obtained, but additionally the said contacts 3 are inserted, towards the rear of their bowed parts 31, preferably by force into notches 72 situated at the rear of the reservoir. This makes it possible, while retaining a fully efficient technique, significantly to increase the efficiency of the reservoir, owing to the fact that the contacts are constrained in the desired position and that their ends are accurately resteered in terms of direction and level.

Figure 3:
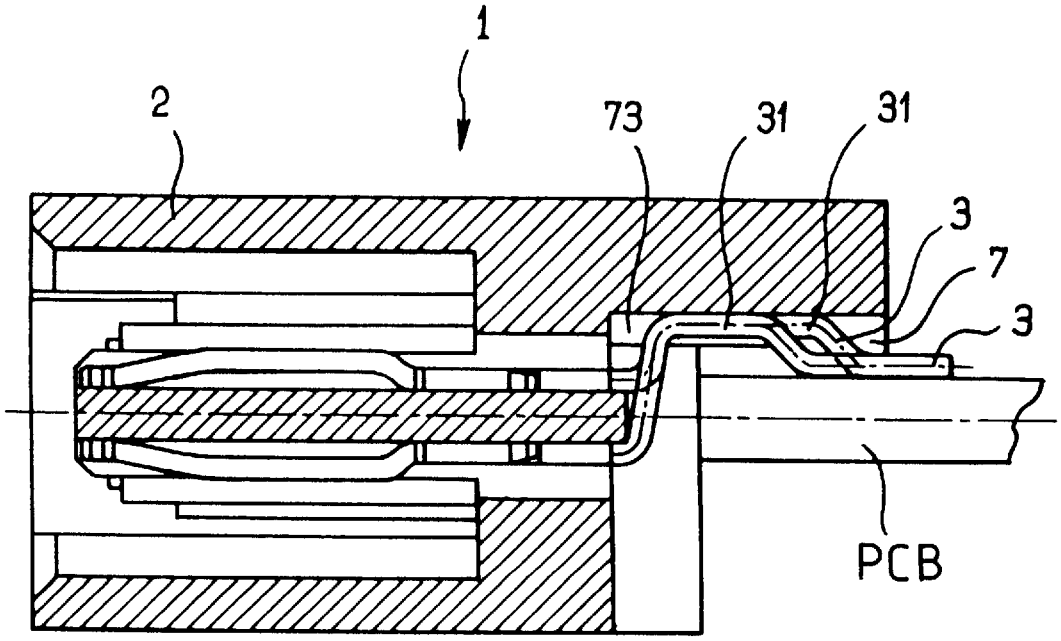
FIG. 3 shows a side view in section of a third embodiment of the connector according to the invention after it is mounted on the PCB.

In FIG. 3, the connector 1 is likewise depicted in a side view, after it is mounted on the PCB, the same labels applying to elements identical to those of FIG. 1. In this third embodiment the means 7 for receiving the insulating compound forms a reservoir comprising at least one seat formed by notches into which the contacts are inserted preferably by force. In this way also, not only are the contacts 3, in a rear portion of their bowed parts 31, immobilized by and in the insulating compound contained in the reservoir thus obtained, but additionally the said contacts 3 are inserted, at the front of their bowed parts 31, preferably by force, into notches 73 situated at the front of the reservoir, the notches 73 forming one (according to FIG. 3) or more seats. This makes it possible, while retaining a fully efficient technique, to obtain a better distribution of the insulating compound, while the contacts 3 are likewise constrained in the desired position.

In FIG. 4*a*, the connector 1 is again depicted in side view, after it is mounted on the PCB, while in FIG. 4*b* it is shown as a rear view, the same labels applying to elements identical to those of FIG. 1. In this fourth embodiment the means 7 for receiving the insulating compound forms a reservoir whose rear edge consists of a snap-fit strip 74 which presses the contacts 3 which are moreover partially inserted into notches formed in the said strip. Consequently, not only are the contacts 3, in almost all of their bowed parts 31, inserted, preferably by force, into notches 740 (see FIG. 4*b*) formed in the snap-fit pressing strip 74 which constitutes the rear edge of the reservoir 7, but additionally are, in their parts preceding the bowed parts 31, immobilized by and in the insulating compound contained in the reservoir thus obtained.

This makes it possible, while retaining a fully efficient technique, significantly to increase the efficiency of the reservoir and furthermore to ensure a repositioning of the contacts 3 likewise constrained in the desired position. In FIG. 4*b* the pressing strip 74 is viewed in a transverse plane, snap-fitted with the aid of two half-dovetails 741 situated on its two lateral parts.

This technique implemented in a non-limiting manner according to the various embodiments, whilst offering excellent reproducibility, affords a simple and efficient solution to the problem posed by the requirement of coflatness. Furthermore, creating a reservoir of cement, either by elongating the insulant of the connector in its rear part, or by modifying the geometry of the notches or else by adding a snap-fit strip which has the effect moreover of repositioning the regions of attachment, advantageously enables the cementing operation to be made more reliable by reducing the criticality of the said cementing. Once the connector has been set in position accurately and reproducibly the said connector, and in particular the set of contacts, is pressed together and surface-mounted in the exact desired plane.

We claim:

1. Process for obtaining an input/output connector for portable communication device intended to be surface-mounted on a printed circuit board (PCB) comprising, an insulating housing on whose lateral parts are fixed two positioning dogs to be soldered to the PCB, contacts to be soldered to the PCB, characterized in that the process comprises an operation of cementing said contacts to the insulating housing, while said contacts are simultaneously pressed against the insulating housing, by means of an insulating compound in such a way as to be held constrained in a position such that each of the contacts is contained in a plane of reference for coflatness of said contacts to be soldered to the PCB.

2. Process for obtaining an input/output connector for portable communication device intended to be surface-mounted an a printed circuit board (PCB) comprising, an insulating housing on whose lateral parts are fixed two positioning dogs to be soldered to the PCB, contacts to be soldered to the PCB, characterized in that the process comprises an operation of cementing said contacts to the insulating housing, while said contact are simultaneously pressed against the insulating housing, by means of an insulating compound in such a way as to be held constrained in a position such that each of the contacts lies in a predetermined tolerance interval with respect to a plane of reference for coflatness of said contacts to be soldered to the PCB.

3. Process for obtaining an input/output connector according to claim 1, characterized in that, to allow a visual check during production on presence of deposition and on homogeneity of the insulating compound, a colouring agent is added to the said insulating compound.

4. Process for obtaining an input/output connector according to claim 1, characterized in that, to allow a check during production on presence of deposition and on homogeneity of the insulating compound by means of black light illumination, a fluorescent colouring agent is added to the said insulating compound.

5. Input/output connector obtained by the process according to claim 1 characterized in that, on a rear part of the housing adjoining the contacts, the housing comprises a means for receiving the insulating compound enabling a volume of the deposited compound to be checked.

6. Input/output connector according to claim 5, characterized in that the means for receiving the insulating compound is a reservoir in which a bowed part of the contacts is immobilized once said contacts have been constrained, by and in the said insulating compound which is flush with edges of said reservoir, the contacts re-emerging towards the rear edge of the reservoir in their region of soldering to the PCB.

7. Input/output connector according to claim 5, characterized in that the means for receiving the insulating compound forms a reservoir delimited in its rear part by notches for redirecting the contacts.

8. Input/output connector according to claim 5, characterized in that the means for receiving the insulating compound forms a reservoir comprising at least one seat formed by notches into which the contacts are inserted.

9. Input/output connector according to claim 5, characterized in that the means for receiving the insulating compound forms a reservoir whose rear edge consists of a snap-fit strip which presses the contacts which are partially inserted into notches formed in said strip.

* * * * *